United States Patent [19]

Kubik

[11] Patent Number: 5,048,292

[45] Date of Patent: Sep. 17, 1991

[54] DUAL PUMP TRAVERSE AND FEED SYSTEM

[76] Inventor: Philip A. Kubik, 1527 Lockridge, Bloomfield Hills, Mich. 48013

[21] Appl. No.: 561,878

[22] Filed: Aug. 2, 1990

[51] Int. Cl.[5] ..... F15B 11/02; F15B 1/02

[52] U.S. Cl. ..... 60/413; 60/371; 60/375; 60/429; 91/519

[58] Field of Search ..... 60/371, 375, 413, 428, 60/429, 470, 475, 477, 486; 91/361, 519

[56] References Cited

U.S. PATENT DOCUMENTS

| | | | |
|---|---|---|---|
| 3,744,375 | 7/1973 | Kubik | 60/433 |
| 4,046,270 | 9/1977 | Baron et al. | 60/413 X |
| 4,738,101 | 4/1988 | Kubik | 60/413 |
| 4,751,818 | 7/1988 | Kubik | 60/444 |
| 4,833,971 | 5/1989 | Kubik | 60/428 X |

*Primary Examiner*—Edward K. Look
*Assistant Examiner*—George Kapsalas
*Attorney, Agent, or Firm*—Basile and Hanloon

[57] ABSTRACT

A single rod three chamber fluid motor is driven in a forward stroke which includes a rapid initial advance followed by a relatively short and slow feed stroke under high pressure. The rapid advance is performed by a closed loop system in which a high displacement main pump, pumps fluid to act against a first equal area at the head side of the piston and receives fluid expelled from a second equal area at the rod side of the piston while an accumulator maintains the third chamber exposed to a third area of the head side of the piston filled with fluid. Upon shifting to the feed stroke, the main pump is disconnected and a feed pump applies pressure to both of the first and third areas at the head side of the piston and receives fluid expelled by the second equal area and from a charge pump. The access fluid added to the feed pump circuit by the charge pump is returned via the accumulator to the charge pump sump during the return stroke of the piston.

5 Claims, 2 Drawing Sheets

SOLENOID CHART

| FUNCTION | | 44A | 44B | 110A | 86A | 124A |
|---|---|---|---|---|---|---|
| RAPID ADVANCE | | + | − | + | − | + |
| FEED | | − | − | − | + | + |
| RAPID RETURN | | − | + | + | − | + |
| NEUTRAL | | − | − | − | − | − |

DUAL PUMP TRAVERSE AND FEED SYSTEM

BACKGROUND OF THE INVENTION

The present invention relates to a dual pump traverse and feed system for controlling the operation of a reciprocatory hydraulic motor in the form of a single rod piston operatively mounted in a three chamber cylinder.

A common requirement in many hydraulic systems is that the piston of a reciprocatory fluid motor be driven at relatively high speed up to a certain point in its forward stroke, and then be driven through the remainder of its forward stroke at a relatively low speed under a relatively high applied pressure. A standard system for accomplishing this result is a so called "high low" system which employs two pumps, one of which can displace a relatively high volume of fluid at relatively low pressure and the other of which can displace a relatively low volume of fluid under high pressure. Because of its limited displacement, the low volume pump is unsuitable for rapidly driving the piston, even when there is no substantial resistance to movement of the piston, while the high volume pump has sufficient capacity to drive the piston rapidly, but cannot apply any substantial amount of pressure to the piston unless it is driven by a relatively high horse power motor. The high low system minimizes the power requirements by connecting the output of both pumps to drive the piston in rapid traverse and then disconnecting and dumping the output of the high volume pump and driving the piston through the final portion of its stroke by the low volume, high pressure pump. Such systems are typically operated in an open loop circuit.

The single rod three chamber motor referred to above includes two chambers within the piston to which equal area piston surfaces are exposed at the rod end side and the head end side of the piston. A third chamber hydraulically isolated from the first two chambers is exposed to a third area on the piston which faces the head end side of the piston. This particular type of motor is well adapted to a rapid traverse, low speed feed application in that rapid traverse in either direction is possible by utilizing the first two chambers, and the pressure applied during the feed portion of the forward stroke may be augmented by supplying fluid under pressure to act against the third area.

While the three chamber cylinder described above is readily adapted to closed loop operation during rapid traverse due to the equal areas on the opposed sides of the piston, a closed loop operation during the feed stroke presents a problem in that more fluid is going into the cylinder—to act on both the third area and the rod side equal area—than is coming out from the chamber at the rod end equal area side of the piston.

While rapid traverse and low speed feed can be achieved simply by connecting a variable displacement pump to opposite sides of a simple cylinder-piston motor, the displacement range of the pump may be such that when operated at a minimum displacement, the volume of fluid supplied to the piston frequently may be too high to reduce the velocity of the piston to the desired velocity of the feed.

The present invention is directed to a dual pump system operable to drive a single rod piston of a three chamber cylinder in rapid traverse in a closed loop system and to drive the piston in a low speed forward feed stroke established by the displacement of one of the dual pumps, and to do this also in a closed loop circuit.

SUMMARY OF THE INVENTION

In accordance with the present invention, the two equal area chambers of a single piston rod three chamber cylinder motor are connected via a directional control valve in a first closed loop system to the intake and outlet of a main system pump of relatively large displacement. The directional control valve is a three position valve which, in its centered position, connects the main pump outlet directly to the main pump inlet so that the main pump idles in a closed loop and the equal area chambers may be connected by the valve to enable the main pump to drive the piston in either a rapid forward or rapid return stroke.

The chamber to which the third piston area of the motor is exposed may be connected via a first two position valve to an accumulator or to a first conduit connected to the head end equal area chamber of the motor. A control system which controls operation of all valves of the system operates the first two position valve to connect the third area chamber of the motor to the accumulator when the piston is being driven in either direction by the main system pump. Thus, during a forward stroke under the control of the main pump, the third chamber of the piston is kept filled by the discharge of fluid under pressure from the accumulator into the third chamber, and this fluid is discharged from the third chamber back into the accumulator during the return stroke.

A feed pump capable of supplying a relatively small volume of fluid under high pressure has its intake connected at all times to the rod end equal area chamber of the cylinder by a second conduit. The outlet of the feed pump is connected to a two position valve which may be selectively actuated by the control system to connect the feed pump outlet either to the first conduit or to the second conduit. When the second two position valve connects the feed pump outlet to the second conduit, the feed pump idles in a closed loop system. The valve is shifted to connect the feed pump outlet to the first conduit only when the directional control valve is in its centered position and the main pump is idling. With this latter connection of the feed pump to the first conduit, the feed pump output is applied to the head end equal area side of the piston and also to the third area so that the piston is driven in feeding movement by pressure applied by the feed pump. The rod end equal area of the piston is connected at all times to the second conduit and thus to the feed pump inlet. In that the volume of fluid expelled from the cylinder via the second conduit is less than that supplied at the head end side of the piston, the additional fluid needed at the feed pump intake is supplied to this intake by a charge pump. Thus, the feed pump, when driving the piston, does so by a closed loop system to which the additional fluid required at the feed pump intake (a volume equal to the third area times the piston displacement) is supplied by the charge pump. Upon the return stroke of the piston, this excess fluid is discharged from the third chamber back to the accumulator and from the accumulator back into the reservoir system under the control of a pressure relief valve.

Other objects and features of the invention will become apparent by reference to the following specification and to the drawings.

DETAILED DESCRIPTION OF THE PREFERRED EMBODIMENT

Figure 1:
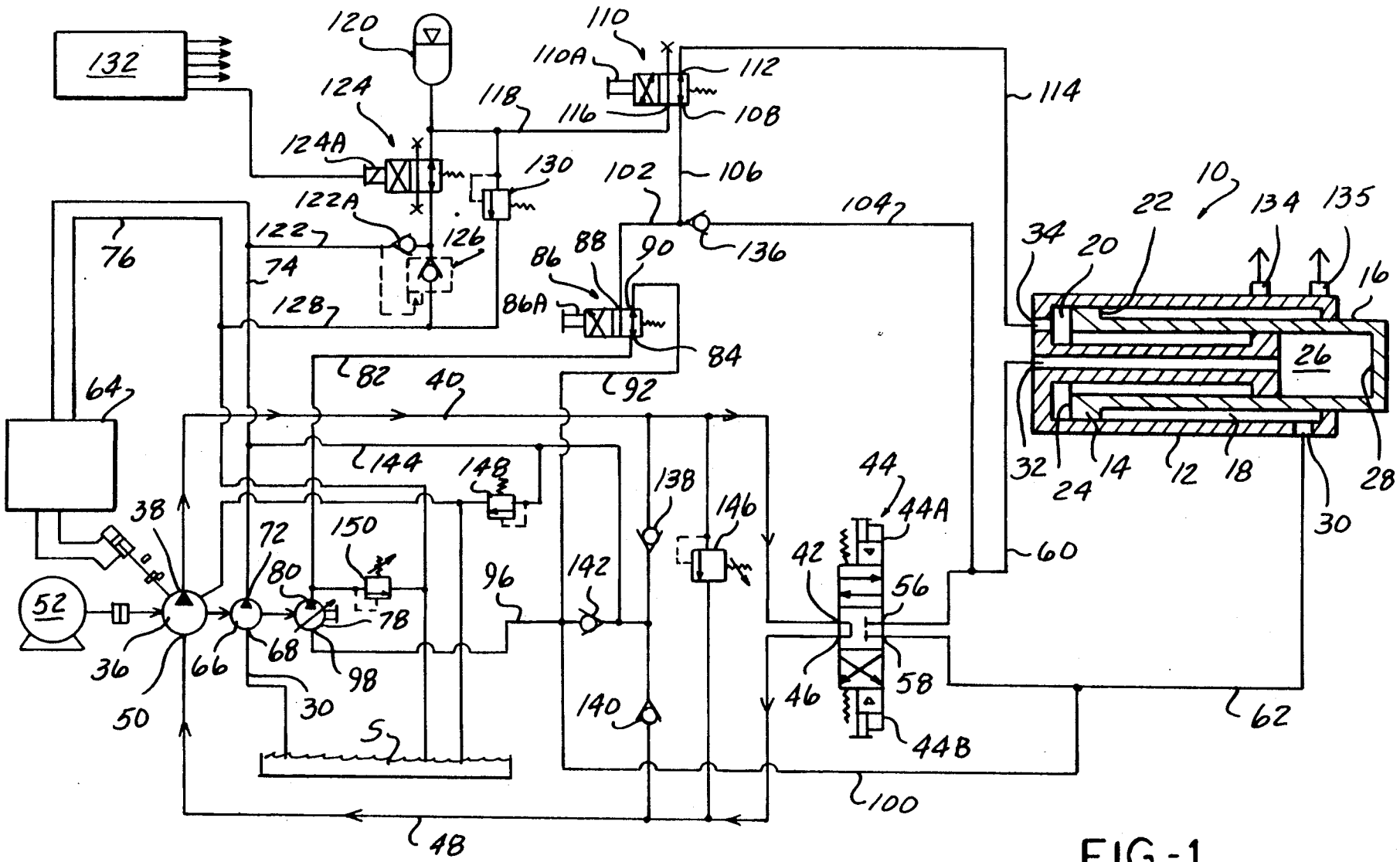
FIG. 1 is a schematic diagram of a dual pump feed control system embodying the present invention.

In FIG. 1, a dual pump feed system embodying the present invention is employed to control a schematically illustrated single rod three chamber hydraulic motor designated generally 10. Motor 10 is of a known construction, and further structural details of such motors may be had by reference to U.S. Pat. Nos. 3,744,375 and 4,751,818. For purposes of the present application, motor 10 is shown schematically as including a cylinder 12 having a piston 14 slidably received within the cylinder with a single piston rod 16 projecting from the rod end of cylinder 12. Piston 14 divides the interior of the cylinder into a rod end chamber 18 and a first head end chamber 20 The piston 14 and cylinder 12 are so constructed as to define within the cylinder 12 a second head end chamber 26 which is hydraulically isolated within the cylinder from chambers 18 and 20. The structural arrangement by which this is accomplished is disclosed in U.S. Pat. No. 4,751,818. An area indicated at 28 at the head end side of the piston is exposed to pressure within second head end chamber 26, and this area 28 is equal to the area 22 of the piston exposed to rod end chamber 18, these two areas being referred to as "equal areas". The area 24 of piston 14 exposed to chamber 20 will be referred to as the third area. The cylinder is provided with rod and head end ports 30, 32 respectively communicating with chambers 18 and 26 and a third port 34 in communication with chamber 20.

The system includes a main system pump 36 having its outlet 38 connected via a conduit 40 to the pressure port 42 of a solenoid actuated three position directional control valve designated generally 44. The return port 46 of valve 44 is connected via conduit 48 to the intake 50 of pump 36. With valve 44 in its normal centered position—neither of solenoids 44A or 44B being energized—pressure port 42 is connected through valve 44 as shown to return port 46 and, with pump 36 being driven by drive motor 52, pump 36 will idle with minimum fluid circulating in a closed loop from the pump through conduit 40, valve 44 and back to the pump via conduit 48. The control ports 56, 58 are isolated from the pressure and return ports 42, 46 of valve 44 when the valve is in its illustrated centered position.

Port 56 is connected via a conduit 60 to the head end port 32 of motor 10 and the other control port 58 is connected via conduit 62 to the rod end port 30 of the motor. It is believed apparent that upon actuation of solenoid 44A of valve 44, the valve will shift to establish the straight through connections from port 42 to port 56 and from port 58 to port 4 and, with these connections made, main pump 36 will drive piston 14 to the right as viewed in FIG. 1, pumping fluid into chamber 20 via port 32 and receiving return fluid discharged from chamber 18 via port 30 in a closed loop arrangement. Upon energization of solenoid 44B, the cross connections between ports 42, 58 and 56, 46 will be established within valve 44 to enable pump 36 to 15 drive piston 14 in movement to the left as viewed in FIG. 1 in a well known manner.

Main pump 36 is a variable displacement pump whose displacement may be controlled by a suitable hydraulically actuated speed control device designated generally 64 whose operating pressure is supplied by a charge/control pump 66 whose intake 68 is connected via conduit 70 to sump S, and whose outlet 72 is connected via a conduit 74 to the speed control device 64. A return conduit 76 returns hydraulic fluid from the speed control unit 64 to sump S. Details of a speed control system of this type are well known and are set forth in U.S. Pat. No. 4,751,818.

A third pump 78 is included in the system to function as a feed pump operable to drive piston 14 of motor 10 at a relatively low speed under high pressure during the feed portion of its working stroke. The outlet 80 of feed pump 78 is connected via conduit 82 to a port 84 of a solenoid actuated two position valve designated generally 86. In the circuit shown, valve 86 functions as a three-way valve to alternatively connect its port 84 to either of two outlet ports 88, 90. In the normal position (solenoid 86A deenergized), valve 36 connects port 84 to port 90 which is in turn connected via conduits 92, 94 to the intake 98 of feed pump 78. With valve 86 in the position shown, feed pump 78 is in an idling condition with fluid circulating in a closed loop from its outlet 80 through valve 86 and back to its intake via conduits 92, 94. Conduits 92, 94, and hence the intake 98 of pump 78 are commonly connected at all times via a conduit 100 to conduit 62 and the rod end port 30 of motor 10.

Upon energization of solenoid 86A, valve 86 is shifted to connect port 84 to port 88 and thence, via conduits 102, 104 and 60 to the head end port 32 of motor 10. A branch conduit 106 connects conduit 102 to a port 108 of a second solenoid actuated two position valve designated generally 110. A second port 112 of valve 110 is connected by a conduit 114 to the third chamber port 34 of motor 10. Like valve 86, valve 110 functions essentially as a three-way valve to selectively connect its port 112 either to port 108 or to port 116. Port 116 is connected via conduit 118 to an accumulator 120. Valve 110 is shown in its normal position in FIG. 1, upon energization of its solenoid 110A, port 112 is connected to port 116 to thereby connect the accumulator 120 to the third chamber 26 of motor 10 via valve 110 and conduit 114.

The accumulator may be charged with fluid under pressure from the outlet conduit 74 of charge pump 66 via a conduit 122 which is normally connected to accumulator 120 via a third solenoid actuated two position valve 124. Valve 124 functions in this instance simply as an on/off valve which is closed upon actuation of its solenoid. When valve 124 is in its normal position shown in the drawings, pressure may be bled from accumulator 120 through an automatic bleed-down valve designated generally 126 connected to sump S via conduit 128 and conduit 76. When valve 124 is closed, pressure in the accumulator is limited by a relief valve 130.

Control of the energization of the various valve actuating solenoids 44A, 44B, 86A, 110A and 124A is accomplished by a schematically illustrated control unit 132. Although control unit 132 is electrically connected to all of the solenoids, only a connection to solenoid 121A has been indicated in FIG. 1 to avoid confusion between electrical and hydraulic lines in the drawings.

In addition to being connected to all of solenoids 44A, 44B, 86A, 110A and solenoid 124A, the control unit 132 is also operatively connected to the speed central system 64 and to sensing devices, such as proximity switches 134, 135 located to sense the arrival of piston 14 at points in its operating cycle where it is desired to shift from a rapid advance operation of the system to a relatively slow feed stroke by first decelerating main pump 36 and then shifting the appropriate valves to bring in feed pump 78.

Many conventional components, such as filters, oil coolers, pressure gages, etc., have not been shown in FIG. 1 in that these components are conventional and do not directly influence the circuit operation. The circuits of FIG. 1 does, however include a one way check valve 136 in conduit 104 oriented to block flow from conduit 104 to conduit 102 while accommodating flow from conduit 102 into conduit 104. Replenishing check valves 138, 140 and 142 are connected in a conventional manner via conduit 144 to the outlet conduit 74 of charge pump 66.

Overload relief valves 146, 148 and 150 are operatively connected as overload relief valves respectively for the main pump, charge pump and feed pump circuits.

OPERATION

The circuit of FIG. 1 is intended to be operable to drive piston 14 in a forward or working stroke to the right as viewed in FIG. 1 in which during the initial portions of the forward stroke, the piston is driven rapidly/ to a predetermined point in its stroke and is then decelerated and subsequently driven at a relatively slow velocity, under high pressure, through the remainder of its forward stroke, this latter portion of the stroke being termed the feed stroke. Upon completion of the forward stroke, the system of FIG. 1 is then operated to return piston 14 rapidly to its original position.

Figures 2, 3:
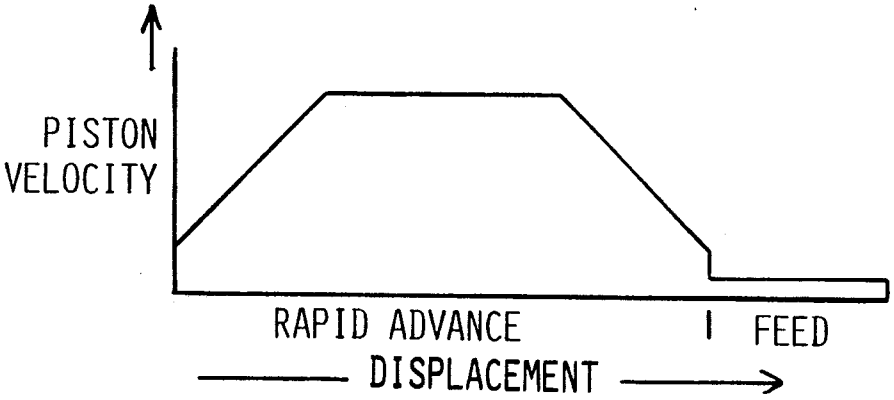
FIG. 2 is a table setting forth the program controlling actuation of the various valve operating solenoids of the system of FIG. 1.
FIG. 3 is a graph of a velocity-piston displacement relationship during a complete forward stroke of the piston.

Operation of the circuit of FIG. 1 is best understood in conjunction with FIGS. 2 and 3. FIG. 2 is a table in which the various operating cycle functions of the system are tabulated against the operating states of the various valve controlling solenoids. In the chart of FIG. 2, a plus sign indicates the particular solenoid of the column in which the sign appears is energized while a minus sign indicates the solenoid is in its normal deenergized state. In FIG. 1, the circuit is in the functional state identified NEUTRAL on the chart of FIG. 2, and the chart indicates that all of the valve operating solenoids are in their normal deenergized state when the system is in a neutral condition.

Referring to FIG. 1, with the system in its NEUTRAL condition, and motor 52 driving main pump 36, charge pump 66 and feed pump 78, motor 10 is isolated from the main pump circuit by the centered valve 44. All solenoid valves are in their normal position as shown in FIG. 1. Main pump 36 idles, pumping fluid from its output side 38 through conduit 40 and through the centered valve 44 from port 42 to port 46 and thence via conduit 48 back to intake 50 of pump 36. Charge pump 68 will maintain a minimum pressure at intake 50 of main pump 36 by pumping fluid from its outlet to the return conduit 48 of main pump 36 via conduit 144 and check valve 145, if necessary.

Feed pump 78 also is idling at this time, pumping fluid from its outlet 80 through conduit 82 to port 84 of valve 86 and through valve 86 to port 90 and back to the feed pump intake 98 via conduits 92 and 94. Replenishment of fluid in this latter closed loop circuit is from charge pump 66 via conduit 144 and check valve 142, if required.

Charge pump 66 at this time is also connected to accumulator 120 via conduit 122 past check valve 122A and valve 124 which, with the system in NEUTRAL is in the position shown in the drawing.

Piston 14 is in its retracted or ready position relative to cylinder 12.

To cause the piston 14 to be driven to the right in a rapid advance movement, the control unit 132 is actuated, either manually or automatically, into a rapid advance state in which, as indicated by the table of FIG. 2, solenoids 44A, 110A and 124A are energized by control unit 132 while solenoids 44B and 86A remain deenergized. Control unit 132 also actuates the speed control system 64 to accelerate main pump 36 to its maximum displacement.

Energization of solenoid 44A will shift valve 44 to position the straight through connections of the valve in alignment with the valve ports, connecting port 42 to port 56 and port 46 to port 58. With these connections established, main pump 50 supplies fluid under pressure through ports 42 and 56 of valve 44 to conduit 60 and thence to the head end chamber 20 of cylinder 12 to act against the head end equal area 28 of piston 14. The rod end equal area chamber 18 of cylinder 12 will be connected via port 30, conduit 62, ports 58 and 46 of valve 44 and return conduit 48 to the intake 50 of the main system pump 36. This establishes a closed loop circuit in which the volume of fluid pumped by main pump 50 into chamber 26 of cylinder 12 against the head end equal area 28 of piston 14 is exactly equal to the volume of fluid expelled by the rod end equal area 22 from chamber 18 and returned to the intake of pump 50 via port 30 of cylinder 12.

Energization of solenoid 110A shifts valve 110 to connect its port 116 to its port 112. This connects accumulator 120 via conduit 118 and valve 110 to conduit 114 which leads to the third area chamber 20 of cylinder 12. Fluid from accumulator 120 can thus flow into third area chamber 20 to maintain this chamber filled as piston 14 moves to the right in response to pressure applied from main system pump 50. As stated above, main system pump 50 is a high displacement pump and the relatively large displacement will move piston 14 rapidly to the right as viewed in FIG. 1. The movement of piston 1 may, for example, be employed to advance a tool into contact with a workpiece. The rapid advance portion of the piston stroke is employed to move the tool from its retracted position into rear contact with the workpiece. The application of feed pressure to the tool is accomplished during the next portion of the working stroke of the piston.

Prior to the completion of the rapid advance portion of the piston stroke, proximity switch 134 signals control circuit 132 to cause speed control system 64 to decelerate main pump 36.

The completion of the rapid advance portion of the working stroke of piston 14 will be signaled to the control unit 132, as by proximity switch 135 which detects the piston position. The control unit 132 then shifts from its rapid advance state to its feed state. As indicated in FIG. 2, when control system 132 is in its feed state, only solenoids 86A and 124A are energized.

With both solenoids 44A and 44B deenergized, valve 44 will return to the centered position shown in FIG. 1, disconnecting main pump 36 from cylinder 12 and permitting main pump 36 to idle as described above.

Deenergization of solenoid 110A permits valve 110 to return to the position shown in FIG. 1, thus isolating accumulator 120 from conduit 114.

Energization of solenoid 86A shifts valve 86 from the position shown in FIG. 1 to a position in which port 84 of valve 86 is connected to conduit 102. With this last connection, the output of feed pump 78 now passes from conduit 82 through valve 86 to conduit 102. Part of the flow into conduit 102 will flow from conduit 102 past check valve 136 and through conduits 104 and 60 to the head end equal area chamber 26 of cylinder 12 to apply the output pressure of feed pump 78 to the head end equal area portion 28 of piston 14. The opposed equal area chamber 18 of cylinder 12 is, at all times, connected via conduits 62, 100 and 94 to feed pump intake 98. Thus, the equal area portions of piston 14 at this time are in a closed loop circuit with the pump 78.

However, fluid flowing from the output of feed pump 78 into conduit 102 also flows via conduit 106 and valve 110, which is now in the position shown in FIG. 1, and thence through conduit 114 to the third area chamber 20 of cylinder 12. The output pressure of feed pump 78, which is a low displacement high pressure pump, is thus applied to both the head end equal area portion 28 of piston 14 and to third area 24 of the piston exposed in chamber 20 which is likewise at the head end of piston 14. This provides a high pressure applied over a substantially large area urging the piston in a forward stroke.

For a given displacement of piston 14 under the foregoing conditions, the volume of fluid applied against the head end of piston 14 is substantially greater than the volume of fluid which is expelled by this given displacement from rod end chamber 18, this excess fluid requirement being equal to the third area 28 of piston 14 multiplied by the piston displacement. With this situation, fluid expelled from chamber 18 returns to the intake 98 of feed pump 78 at a rate which is substantially less than the rate at which fluid is being discharged from the pump outlet. The shortage of fluid during the feed stroke is made up by charge pump 66, whose outlet is connected via conduit 144 and one way check valve 142 to the intake conduit 94 of feed pump 78. This excess fluid is effectively all supplied to the third area chamber 26 of cylinder 12.

When the control unit is subsequently shifted to return piston 14 to its original position, the entire return stroke is accomplished by main pump 36. With the control unit in its rapid return state, solenoids 44B, 110A and 124A are energized while solenoids 44A and 86A are deenergized.

With solenoid 44B energized, valve 44 is shifted to align its cross connections with the valve ports to connect port 42 to port 58 and port 46 to port 56. Main pump 36 is thus connected in a closed loop circuit across the equal area chambers 18, 22 of cylinder 12 to supply fluid under pressure to rod end chamber 18 and to discharge fluid from head end chamber 22 to the intake side of pump 36. With solenoid 86A deenergized, the output of feed pump 78 is connected, via valve 86 and conduit 92 to its intake conduit 94. Insofar as the two equal area portions of piston 14 are concerned, the piston is in a closed loop circuit with main system pump 36 and is thus being driven in a rapid return stroke to the left as viewed in FIG. 1 by virtue of the high displacement characteristic of pump 36.

As indicated in FIG. 2, during the rapid return phase of operation, solenoid 110A is energized, thereby connecting conduit 114 to conduit 118 which leads to accumulator 120. As piston 14 moves to its left during the rapid return stroke, the third area 24 of the piston expels fluid from the third chamber 20 of cylinder 12, and all of this fluid is conducted via conduit 114, valve 110 and conduit 118 back to accumulator 120 to recharge the accumulator.

The excess fluid added to the feed pump circuit during the feeding stroke was that amount of fluid introduced into the third chamber 20 of cylinder 12 during the feed stroke, and during the return stroke of the piston, this excess amount of fluid is returned to the accumulator. In that the maximum pressure of fluid within the accumulator is designed to be equal to the maximum pressure supplied by charge pump 66, excess pressure in accumulator 120 resulting from the return of more fluid to the accumulator during the return stroke of the piston than was expelled from the accumulator during the advance and feed strokes, is relieved from the accumulator via relief valve 130, conduit 128 and return conduit 76 to be dumped into the sump S.

Referring now particularly to FIG. 3, a plot of the velocity of piston 14 versus displacement from its rest position during a forward stroke shows that the velocity builds up initially to a maximum velocity which is maintained and then gradually reduced until the piston is at a displacement from its rest position (the position of proximity 135) at which the feed portion of the forward stroke is to commence. Acceleration and deceleration of the piston at the beginning and end of the rapid advance portion of its stroke is accomplished by speed control unit 64 which includes a valve shiftable under the control of control unit 132 to commence the deceleration portion of the rapid advance phase when proximity switch 134 is triggered. It will be noted that the velocity at the beginning and end of the rapid advance phase is not zero. In effect main pump 36 has a minimum operating displacement which, when the pump is connected to motor 10, will move the piston of motor 10 at some velocity greater than zero. Feed pump 78, however, is chosen as a relatively low displacement, high output pressure pump whose displacement may be chosen to achieve a high output pressure for a given amount of power input to drive the piston over a relatively short distance to, for example, move a tool in feeding stroke during machining.

In the circuit shown in FIG. 1, when main pump 36 is driving the position of cylinder 10 in its forward and return traverse strokes, pump 36 is hydraulically connected via directional valve 44 in a closed loop system to the equal area chambers of 18, 22 of cylinder 10. The advantage of the closed loop system is that it enables main pump 36 to apply a dynamic braking action to movement of piston rod 16—fluid expelled from one equal area chamber of the cylinder cannot flow into the main pump intake any faster than fluid is being pumped from the main pump outlet into the other equal area chamber of the cylinder.

An alternative main pump circuit having dynamic braking capabilities can be achieved by replacing the standard three position directional control valve 44 shown in FIG. 1 with a commercially available electro-hydraulic proportional directional control solenoid valve. As compared to the standard directional control valve in which the valve passages are either fully open or fully closed, the proportional valve is capable of partially opening the valve passages to establish a selectively adjusted flow rate to and from the equal area chambers of cylinder 10 at a selected proportion of the fully open flow rate. With the proportional valve, which may be controlled by appropriate programming of controller 132, a dynamic braking effect can be achieved. In such an arrangement, the main pump may be a fixed displacement pump, in which case the function of speed control circuit 64 of the circuit of FIG. 1 is performed by control circuit 132 and the proportional valve. The circuit between the main pump and the pressure and tank ports of the proportional valve can be an open loop circuit, with the tank port of the valve and the pump intake being connected to sump.

While one embodiment of the invention has been described in detail, it will be apparent to those skilled in the art the disclosed embodiment may be modified. Therefore, the foregoing description is to be considered exemplary rather than limiting, and the true scope of the invention is that defined in the following claims.

I claim:

1. Hydraulic circuit means for selectively driving a single rod piston operatively disposed in a three chamber hydraulic cylinder in forward and return strokes, said piston having equal areas on its rod end side and its head end side respectively exposed in first and second chambers of said cylinder and a third area on its head end side exposed in the third chamber of said cylinder, said circuit means comprising a main pump connected to said first and second chambers of said cylinder via directional control valve means in a first circuit to drive said piston in a forward traverse stroke when said valve means is in a first position and to drive said piston in a return traverse stroke when said valve means is in a second position, a feed pump having an intake and an outlet, first conduit means connecting said first chamber of said cylinder to said intake of said feed pump, second conduit means connected to said second chamber of said cylinder, first two position valve means 86 operable in a first position to connect said outlet of said feed pump to said second conduit means to drive said piston in a forward feed stroke and operable in a second position to connect said outlet to said first conduit means to enable said feed pump to idle via a second closed loop circuit, accumulator, and second two position valve means operable in a first position to connect said third chamber to said accumulator and operable in a second position to connect said third chamber to said second conduit means.

2. The invention defined in claim 1 wherein said directional control valve means includes a three position valve having an inlet port connected to the main pump outlet, a return port connected to the main pump intake, a first control port connected to said first chamber and a second control port connected to said second chamber, said valve means being operable in a third position to block said first and second control ports and to connect said inlet port to said return port to enable said main pump to idle in a closed loop circuit.

3. The invention defined in claim 2 further comprising a third two position valve means operable in a first position to connect said accumulator to said charge pump and operable in a second position to isolate said accumulator from said charge pump, said control means being operable to position said third valve means in its first position when both of said main and feed pumps are idling and to position said third valve means in its second position when either of said main or feed pumps is driving said piston.

4. The invention defined in claim 1 further comprises control means for controlling said directional control valve means and said first and second two position valve means, said control means being operable to position said first valve means in its second position and to position said second valve means in its first position when said control means positions said directional valve in either of its first and second positions and operable to position said first valve means in its first position and to position said second valve means in its second position when said control means positions said directional valve in its third position whereby one of said main pump and feed pump idles in a closed loop circuit while the other of said main pump and feed pump is driving said piston.

5. The invention defined in claim 1 further comprising charge pump means for maintaining a predetermined minimum pressure at the intake of said feed pump.

* * * * *